US008342422B2

(12) United States Patent
Claessens

(10) Patent No.: US 8,342,422 B2
(45) Date of Patent: Jan. 1, 2013

(54) DRINK CONTAINER STRAW

(76) Inventor: Dominique Claessens, Rolling Hills, CA (US)

( * ) Notice: Subject to any disclaimer, the term of this patent is extended or adjusted under 35 U.S.C. 154(b) by 36 days.

(21) Appl. No.: 12/875,922

(22) Filed: Sep. 3, 2010

(65) Prior Publication Data

US 2012/0056008 A1 Mar. 8, 2012

(51) Int. Cl.
*A47G 21/18* (2006.01)
*A61J 15/00* (2006.01)

(52) U.S. Cl. ..... 239/33; 239/24

(58) Field of Classification Search ..... 239/24, 239/33

See application file for complete search history.

(56) References Cited

U.S. PATENT DOCUMENTS

| | | | | |
|---|---|---|---|---|
| 662,345 | A * | 11/1900 | Britton, et al. | 239/33 |
| 2,150,439 | A * | 3/1939 | Hamilton | 239/33 |
| 2,867,536 | A * | 1/1959 | Mead et al. | 426/85 |
| 3,610,483 | A * | 10/1971 | Visconti et al. | 222/478 |
| 4,921,713 | A | 5/1990 | Fowler | |
| 5,222,940 | A | 6/1993 | Wilk | |
| 5,718,681 | A | 2/1998 | Manning | |
| 5,753,284 | A | 5/1998 | Green et al. | |
| 5,780,058 | A * | 7/1998 | Wong et al. | 424/473 |
| 6,109,538 | A | 8/2000 | Villani et al. | |
| 6,482,451 | B1 | 11/2002 | Baron | |
| 6,541,055 | B1 | 4/2003 | Luzenberg | |
| 6,595,951 | B1 | 7/2003 | Wong et al. | |
| 6,638,549 | B1 | 10/2003 | Lloyd | |
| 2001/0038871 | A1 | 11/2001 | Nardi | |
| 2004/0164174 | A1 * | 8/2004 | Day | 239/33 |
| 2005/0109858 | A1 | 5/2005 | Sedaghat Kerdar | |
| 2005/0142252 | A1 | 6/2005 | Brown et al. | |
| 2005/0218242 | A1 * | 10/2005 | Renz et al. | 239/24 |
| 2006/0065758 | A1 | 3/2006 | Hamer | |
| 2006/0169791 | A1 | 8/2006 | Taylor et al. | |
| 2007/0262164 | A1 | 11/2007 | Gelfand | |
| 2008/0075809 | A1 | 3/2008 | Anderson | |
| 2008/0197141 | A1 | 8/2008 | Felfoldi | |

FOREIGN PATENT DOCUMENTS

| | | | |
|---|---|---|---|
| KR | 10-2010-0052368 | A | 5/2010 |
| WO | WO 03-101226 | A1 | 12/2003 |
| WO | WO 2008-062241 | A1 | 5/2008 |

* cited by examiner

*Primary Examiner* — Len Tran
*Assistant Examiner* — Justin Jonaitis
(74) *Attorney, Agent, or Firm* — David A. Belasco; Belasco Jacobs & Townsley, LLP

(57) ABSTRACT

A drink straw container includes a hollow, elongated body that has a first end, a second end, an inner wall and an outer wall. The body has a frangible seal at the first end and a one-way valve located adjacent the second end that permits passage of fluids only from the second end toward the first end. The elongated body securely encloses a predetermined quantity of a consumable liquid. The inner and outer walls extend below the one-way valve to protect the valve from contacting a container surface. The lower end of the body may have a sealing membrane and a sliding puncture device to pierce the membrane. The straw may have an inner tube with a series of penetrating apertures for combining the consumable liquid with a mixing beverage. The straw may have a manually operated valve and a diameter reducing choke at the lower end of the straw.

1 Claim, 7 Drawing Sheets

DRINK CONTAINER STRAW

FIELD OF INVENTION

This invention relates to the field of beverage containers, and more specifically to an apparatus that allows a consumer to securely transport a small quantity of a beverage and conveniently add the beverage to a larger beverage container without risk of spillage.

BACKGROUND OF THE INVENTION

Personal beverage containers have long been popular with traveling partygoers for carrying a small quantity of a favorite beverage for onsite consumption in locations not providing liquid refreshments. Hip flasks, hollow canes, ski poles and even crutches have been used for such purposes. These devices, while serving their intended purposes, are often inconvenient as one must clean and fill them and plan for their use ahead of time. A more convenient solution involves providing a sealed, disposable container housing the desired quantity of the favorite beverage. Often these favorite beverages are a form of liquor that is suitable for mixing with soft drinks or other non-alcoholic beverages. These mixers are typically packaged in cans or bottles. The present invention provides a convenient means to rapidly combine the favorite beverage or liquor with a mixer in its can or bottle. In addition, the invention provides a means for the consumer to experience a "shot" of the favorite beverage followed immediately by a drink of the mixer. The present invention includes several versions of a drink straw container providing these capabilities. A number of straw and container related inventions have been developed.

U.S. Pat. No. 2,867,536, issued to Mead, discloses a drinking straw where a soluble flavoring material is contained within an annular space between an inner and an outer tube. The inner tube has a bore through which drink flavored by the material can be drawn when drinking straw is inserted in consumable liquid. During use, the upper and lower caps are removed, the flavoring material emptied into the liquid and the flavored liquid drawn up through the inner tube and into the mouth.

U.S. Pat. No. 3,610,483, issued to Visconti is directed to a dispensing device for liquid medication formed in the shape of a straw. The device has a passage extending therethrough with the upper end closed by a removable cover. The lower end has means to permit the introduction of air into the passage whereby suction on the upper end of the passage results in the liquid medication within the passage being dispensed into the month of the user. The device is filled to a predetermined level with the liquid medication. The ends of the passages are sealed adjacent the openings by a cup-shaped closure member. The closure member is removed from the upper end of the members. When the patient sucks on the upper end of the tubular member, air is introduced into the passage in the member whereby the liquid medication is sucked through the upper end of the passage into the patient's mouth. The lower end of the passage is closed by a membrane formed of a suitable material that will permit air to flow into the passage when suction is applied at the upper end of the passage, while preventing the flow of liquid medication from the passage through the membrane. When the liquid medication in the passage in the tubular member is to be taken, the closure member at both ends are removed. Then suction on the upper end of the passage results in the liquid medication being sucked from the passage due to the air flowing through the membrane.

U.S. Pat. No. 4,921,713, issued to Fowler illustrates a straw assembly for imparting flavor to otherwise neutral liquids such as milk or water which includes a first section of straw for immersion in the neutral liquid and a second section of straw for placing in the user's mouth. Intermediate to the two sections of straw is a chamber, which may be an intermediate section of the straw, for containing flavor imparting material. The flavor imparting material may take the form of a separate enlarged chamber containing the flavor material.

U.S. Pat. No. 5,222,940, issued to Wilk disclose a device for facilitating administration of medicine to a patient comprising a straw having a lower end and an upper end, a cup-shaped member defining a receptacle space, and graduation markings or other indicators on the cup-shaped member for providing a volumetric indication of an amount of liquid deposited into the receptacle space. The cup-shaped member is connected to the straw at the lower end so that a lower tip of the straw communicates with a lower region of the receptacle space.

U.S. Pat. No. 5,718,681, issued to Manning is directed to a medication delivery straw which delivers medication held within the straw tube. When the patient drinks fluid through the straw, the medication is dissolved and ingested by the patient. A particle barrier at one end of the straw prevents viscous or powdered medicines, or crushed tablets, from falling out of the straw. The particle barrier has apertures which allow fluid to enter the straw during use. The fluid dissolves the medication in the straw while the patient is drinking. Optional features include disposable funnels (which may be preloaded with medicine) for filling the straw with the correct dosage of medication. Other embodiments use preloaded straws which may contain either crushable tablets or breakable cartridges. In an alternative embodiment the invention stores medicine in a flexible neck prior to use. A thin breakable membrane holds medicine inside of the flexible neck so long as the flexible neck is not extended. The flexible neck and breakable membrane form a medicine storage compartment (i.e., a pocket).

U.S. Pat. No. 5,753,284, issued to Green discloses a method of preparation of an edible plug for sealing an end of a drinking straw containing liquid nourishment.

U.S. Pat. No. 5,753,284, issued to Wong discloses an oral active agent delivery system and method for delivering an active agent formulation to a patient. An active agent formulation chamber containing the active agent formulation and having a fluid passing active agent formulation retainer is placed at one end into a fluid and at a second end into a patient's mouth. The active agent is delivered when the patient sips on the end of the chamber. When the patient applies suction to the second end of the device it causes delivery of the fluid and the active agent formulation into the patient's mouth. A removable end cap and a one-way plug are disclosed. See also the following related patents issued to Wong: U.S. Pat. Nos. 5,989,590; 6,106,845; 6,210,713; 6,333,050.

U.S. Pat. No. 6,109,538, issued to Villani discloses a straw for adding a flavoring to a liquid passing through the straw. There are spaced apart screens disposed in the lumen of the tube. A flavoring object is disposed in the lumen between the screens.

U.S. Patent Application No. 2001/0038871, published for Nardi discloses an agent-delivery system for dispensing active agents of choice into ingestible materials of choice. The agent-delivery system includes a component for retaining the agent, typically in an extract form, which component is directed by the user into contact with an ingestible material. The extract is preferably water-soluble so that it may be dissolved into a fluid, generally a beverage of choice. The agent-retaining component may be a straw. A predetermined quantity of a water-soluble extract is preferably sprayed onto the interior surface of the straw The agent will be ingested by a user when a fluid is transferred from a container through the straw to the user until the extract is dissolved. The straw may be individually wrapped as for one-time agent purchases, or it may come packed with a plurality of similarly treated straws.

U.S. Pat. No. 6,482,451, issued to Baron discloses a flavoring receptacle containing a predetermined portion of flavoring agent for sale and use in conjunction with a compatible pre-packaged unflavored beverage of appropriate relative volume. The flavoring receptacle is generally elongate and tubular in shape and contains end caps. The flavoring receptacle is thereby adapted for use as a straw. Passage of the unflavored beverage through the flavoring receptacle provides for mixing with the flavoring agent to produce a flavored beverage.

U.S. Pat. No. 6,451,055, issued to Luzenberg discloses a porous article for dispensing a soluble dispensate into fluid. It may be attached to a sports bottle straw to introduce the substance into a fluid coming in contact with the article.

U.S. Pat. No. 6,595,951, issued to Wong is directed to a closure system for an oral active agent delivery device. The device comprises an elongate tubular member having first and second ends. The closure system includes a deformable closure means adapted to allow delivery of the active agent upon deformation. The closure system prevents spillage and maintains the integrity of the dose within the device. In use, the closure system is deformed and separated from the second end of the tubular member, liquid is drawn up into the first end of the member, and the liquid and active agent are drawn out of the second end of the member and into the patient's mouth.

U.S. Patent Application No. 2005/0109858, published for Sedaghat Kerdar discloses an administration form for oral administration of active ingredients, vitamins and/or nutrients, comprising a straw with a sealing device in the form of a straw part which can he bent in a reversible manner between the formulation and the opening of the straw providing free access to the formulation, When the part is bent, the formulation is prevented from exiting from the straw. The invention also relates to a kit consisting of the administration form and a transport liquid, and to a method for the production of the administration form. The drinking straw contains a precisely determined dose of substance.

U.S. Patent Application No. 2005/0142252, published for Brown discloses an additive lozenge in a solid form which is attached to the lower end of a straw. The lozenge dissolves when stirred in a liquid Once dissolved, the person mixing the additive lozenge into the liquid can drink the modified drink through a sip end of the straw.

U.S. Patent Application Nos. 2005/0116057 and 2006/0065758, published for Hamer disclose a straw containing a jellied shooter, a granita or a slush which preferably contains a potable alcohol. The straw has end caps which may he heat sealed or attached with adhesive. In one embodiment, a 12 inch straw is disclosed. The straw may be sold as a preloaded product for single use. See FIGS. 1 & 5. A party game employing the device is disclosed. This patent also references "Tooters Shooters" which are disposable test tube shot glasses.

U.S. Patent Application No. 2006/0169791, published for Taylor, discloses a sip straw with an outer tubular member and an inner tubular member. The outer tubular member is formed of a spirally wound paper wrapper which is wound onto the outer surface of the inner tubular member. The inner tubular member is formed of an edible substance such as chocolate, which imparts a flavor to a fluid being drawn through the inner tubular member by a user. The consumable component may comprise a wide variety of materials including but not limited to, nutritional materials such as vitamins, minerals and/or other nutrition enhancers.

U.S. Patent Application No. 2007/0262164, published for Gelfand discloses a drinking straw which includes a tube having a distal opening and a proximate opening as well as a one-way valve attached to the distal opening of the straw. The valve is preferably made from a flexible material so that it can easily and conveniently be removed from the distal opening of the straw. In one preferred embodiment, the valve at the proximal opening comprises a cylindrical elastomeric body with a first end and second end. The first end is connected by a cylindrical midsection to the second end which has an oval shaped outer wall terminating in an open mouth.

The valve further includes parabolically tapered walls located near the first end converging towards an elongated slit defined by lips. A collar is also positioned near the second end which projects radially outwardly from the outer wall of the midsection. In another preferred embodiment, the straw is part of a kit which includes devices for measuring and loading substances into the drinking straw. Also disclosed are methods for using the drinking straw to administer medications. In one preferred embodiment, a user loads a substance through the proximate opening of the tube of the straw, places the opposite opening of the tube into a beverage of choice and sips on the proximal opening of the tube so the beverage is drawn up through the elongated slit of the valve into the tube, mixes with the loaded substance and is then drawn into the mouth of the user. Liquid substances may be preloaded.

U.S. Patent Application No. 2008/0075809, published for Anderson discloses a drinking straw that can be used to dispense a substance such as vitamins, pharmaceuticals, or diet supplements that is stored inside of the straw body. The straw includes a one-way liquid flow valve at one end of straw that prevents drawn liquid and any of the dissolved materials from returning to the initial liquid source that is drawn through the straw when the straw is not in use. The straw may include a one-way valve or crimp for acting as a one-way valve. The enclosed substance can dissolve during the drawing action. In an alternate embodiment to further enhance the containment of liquid in the straw, the straw body can be pressed close together at each end to act as a liquid restrictor but still permit liquid to flow therethrough under suction when the user sucks on the moist straw bulbous end. This crimping of the straw at each end forms an internal chamber that contains a dissolvable substance that cannot pass through the crimped areas of the straw. However, the liquid still can pass through the crimped areas when the straw is in operation (suction) allowing loose beads to be trapped in a straw for dissolution during operation.

U.S. Patent Application No. 2008/0197141, published for Felfodi discloses a drinking straw which is sealed and/or re-sealable at the ends and which can serve as a supply container for a dry food product. This patent discloses a variation on the invention wherein it is a one-piece design and is equipped with a mouthpiece at each end which is conical and tapering towards the straw. In a further variant of the invention, the straw is a one-piece design and it is sealed at both ends. One of the ends is welded and, after filling the container with the dry food product, the other end used for filling up is also welded. The welded ends of the straw are rounded off, preventing injuries to the mouth or lips. Around the grooving the flow of fluids (of water, milk, spirits or similar) is at its strongest and the flow is lead directly to the dry contents of the straw. With this embodiment, the closure is located between straw end and end-piece. The closure is then opened by way of mechanical impact such as rubbing or squeezing or by way of contact with the liquids. In a further variant of the present invention, the straw is a one-piece design. It consists of a middle section and is equipped with a mouthpiece at each end which is conical, tapering towards the straw. Below this conical range the straw is deformed by 90 degrees creating a cross-shaped opening. The opening has two braces and is sufficiently large to ensure the flow of liquid inside the straw without requiring too much suction.

It is an objective of the present invention to provide a secure container for a small quantity of a favorite beverage, such a container should be flexible and resistant to impact. It is a further objective to provide such a container that is size compatible with the openings of typical mixer bottles and cans. It is a still further objective of the invention to provide a container that includes a one-way valve at one end that can be opened by suction from the consumer. It is yet a further objective to provide a container that can be easily protected from dirt and contamination. Finally, it is an objective of the present invention to provide such a container that is attractive in form, durable and inexpensive to produce.

While some of the objectives of the present invention are disclosed in the prior art, none of the inventions found include all of the requirements identified.

SUMMARY OF THE INVENTION

The present invention addresses all of the deficiencies of prior art drink straw container inventions and satisfies all of the objectives described above.

(1) A drink straw container providing the desired features may be constructed from the following components. A hollow, elongated body is provided. The body has a first end, a second end, an inner wall and an outer wall. The body has a frangible seal at the first end and a one-way valve located adjacent the second end. The one-way valve permits passage of fluids only from the second end toward the first end. The elongated body securely encloses a predetermined quantity of a consumable liquid.

(2) In a variant of the invention, the inner and outer walls extend below the one-way valve for a first predetermined distance.

(3) In another variant, the inner and outer walls extending below the one-way valve have either at least one aperture or at least one slit.

(4) In still another variant, the one-way valve includes a plurality of overlapping inwardly folding pleats. The pleats are formed of resilient material.

(5) In yet another variant, the inwardly folding pleats are initially held in a sealing position by a frangible adhesive.

(6) In a further variant, the one-way valve includes a surrounding ledge and a flap. The ledge is located upon the inner wall of the hollow body. The flap is pivotally secured above and adjacent to the surrounding ledge.

(7) In still a further variant, the flap is initially held in a sealing position by a frangible adhesive.

(8) In yet a further variant, the one-way valve includes a surrounding ledge and a pair of overlapping vanes. The ledge is located upon the inner wall of the hollow body and the pair of vanes is pivotally attached above and adjacent to the surrounding ledge.

(9) In yet another variant, the overlapping vanes are initially held in a sealing position by a frangible adhesive.

(10) In still another variant, the one-way valve is located within a sleeve. The sleeve is sized and shaped to fit sealably over the second end of the body.

(11) In yet another variant, the sleeve extends below the one-way valve for a first predetermined length.

(12) In a further variant, a portion of the sleeve that extend below the one-way valve has either at least one aperture or at least one slit penetrating a side wall of the sleeve.

(13) In still a further variant, an upper end of the sleeve adjoins the outer wall of the body with either a rounded filet or a beveled edge.

(14) In yet a further variant, a joint between the second end of the body and a portion of the sleeve above the one-way valve is secured with an O-ring seal.

(15) In another variant of the invention, the frangible seal has a burst strength greater than burst strength of the body.

(16) In still another variant, a lower membrane is provided. The membrane seals the second end of the body and prevents contamination of an interior of the body. A sliding puncture device is provided. The device is sized and shaped to fit slidably over the second end of the body and has an upward pointing puncturing member affixed to an inner surface of a perforated end cap. The puncturing member penetrates the membrane as the puncture device is moved upwardly, thereby permitting the consumable liquid to move upwardly under suction through the hollow body and a mixing beverage to pass into the body through the perforated end cap.

(17) In yet another variant, a removable strip of sealing tape is provided. The tape secures the sliding puncture device to the elongated body to prevent accidental puncturing of the membrane.

(18) In a further variant, a ridge is located about a circumference of the hollow body and at least one resilient tab is provided. The tab is sized, shaped and located to impede upward movement of the sliding puncture device and requires a predetermined force to permit passage of the device beyond the ridge.

(19) In still a further variant, a hollow, elongated body is provided. The body has a first end, a second end, an inner wall and an outer wall. The body has a frangible seal at the first end and a lower membrane. The membrane seals the second end of the body and prevents contamination of an interior of the body. The elongated body securely encloses a predetermined quantity of a consumable liquid. A sliding puncture device is provided. The device is sized and shaped to fit slidably over the second end of the body and has an upward pointing puncturing member affixed to an inner surface of a perforated end cap. The puncturing member penetrates the membrane as the puncture device is moved upwardly, thereby permitting the consumable liquid to move upwardly under suction through the hollow body and a mixing beverage to pass into the body through the perforated end cap.

(20) In yet a further variant, a removable strip of sealing tape is provided. The tape secures the sliding puncture device to the elongated body to prevent accidental puncturing of the membrane.

(21) In another variant of the invention, a ridge is located about a circumference of the hollow body and at least one resilient tab is provided. The tab sized, shaped and located to impede upward movement of the sliding puncture device and requires a predetermined force to permit passage of the device beyond the ridge.

(22) In still another variant, an outer elongated hollow body is provided. The outer body has a first predetermined length, a first end, a second end, an inner wall and an outer wall. An inner elongated hollow body is provided. The inner body has the first predetermined length, a proximal end, a distal end, an inside wall, an outside wall and a plurality of apertures penetrating the inside and outside walls. A lower platform is provided. The lower platform connects and seals the outside wall of the inner body to the inner wall of the outer body and supports the inner body within the outer body. A first frangible seal is provided. The first seal removably secures the first end of the outer body and the proximal end of the inner body. A second frangible seal is provided. The second seal removably secures the distal end of the inner body. A predetermined quantity of a consumable liquid is provided. The liquid is securely enclosed within the inner body and between the inner body and the outer body.

(23) In yet another variant, a one-way valve is located adjacent the distal end of the inner body. The one-way valve permits passage of fluids only from the distal end toward the proximal end.

(24) In a further variant, the inside and outside walls extend below the one-way valve for a first predetermined distance.

(25) In still a further variant, the inside and outside walls that extend below the one-way valve have either at least one aperture or at least one slit.

(26) In yet a further variant, the one-way valve includes a plurality of overlapping inwardly folding pleats. The pleats are formed of resilient material.

(27) In another variant of the invention, the inwardly folding pleats are initially held in a sealing position by a frangible adhesive.

(28) In still another variant, the one-way valve includes a surrounding ledge and a flap. The ledge is located upon the inside wall of the inner hollow body and the flap is pivotally secured above and adjacent to the surrounding ledge.

(29) In yet another variant, the flap is initially held in a sealing position by a frangible adhesive.

(30) In a further variant, the one-way valve includes a surrounding ledge and a pair of overlapping vanes. The ledge is located upon the inside wall of the inner hollow body and the pair of vanes is pivotally attached above and adjacent to the surrounding ledge.

(31) In still a further variant, the overlapping vanes are initially held in a sealing position by a frangible adhesive.

(32) In yet a further variant, a hollow, elongated body is provided. The body has a first end, a second end, an inner wall and an outer wall. The body has a first frangible seal at the first end and a second frangible seal at the second end. A manually operated valve is located within the hollow body and spaced downwardly from the first end. The elongated body securely encloses a predetermined quantity of a consumable liquid.

(33) In still a further variant, the inner and outer walls extend below the valve for a first predetermined distance.

(34) In yet a further variant, the inner and outer walls that extend below the valve have either at least one aperture or at least one slit.

(35) In another variant, the valve is in a normally closed position and opens upon manual pressure on the hollow body adjacent the valve.

(36) In still another variant, the second end of the hollow, elongated body further includes a choke. The choke reduces a cross-sectional area of the straw from a first predetermined size to a second, smaller predetermined size.

(37) In yet another variant, the choke further includes a sleeve. The sleeve is sized and shaped to fit sealably over the second end of the hollow, elongated body.

(38) In a final variant of the invention, a drink container straw includes a hollow, elongated body. The body has a first end, a second end, an inner wall and an outer wall. The body has a frangible seal at the first end and a lower membrane. The membrane seals the second end of the body and prevents contamination of an interior of the body. The elongated body securely encloses a predetermined quantity of a consumable liquid. A protective end cap is provided. The end cap fits slidably over the outer wall adjacent the second end of the body. The end cap secures the membrane to the second end. The membrane is breakable by suction applied to the straw by a user. When the membrane is broken it permits the consumable liquid to move upwardly under suction through the hollow body and permits a mixing beverage to pass into the body through the second end.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-20 illustrate a drink straw container 10 providing the desired features may be constructed from the following components. As illustrated in FIGS. 1 and 2, a hollow, elongated body 14 is provided. The body 14 has a first end 18, a second end 22, an inner wall 26 and an outer wall 30. The body 14 has a frangible seal 34 at the first end 18 and a one-way valve 38 located adjacent the second end 22. The one-way valve 38 permits passage of fluids 42 only from the second end 22 toward the first end 18. The elongated body 14 securely encloses a predetermined quantity of a consumable liquid 46.

Figure 1:
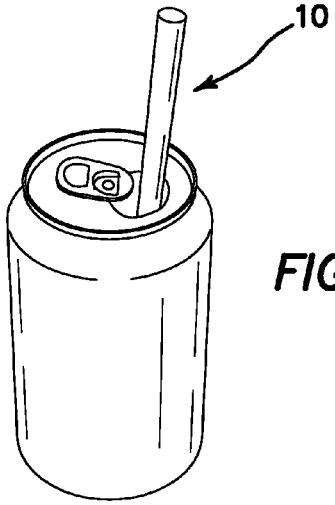
FIG. 1 is a perspective view of the preferred embodiment of the invention located in the opening of a beverage container.
Figure 2:
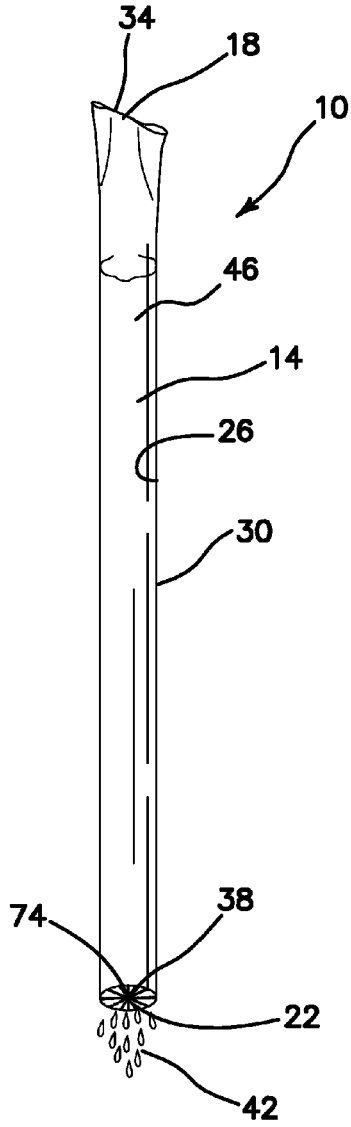
FIG. 2 is a perspective view of the FIG. 1 embodiment illustrating a frangible seal at an upper end and a one-way valve located in the hollow body.
Figure 3:
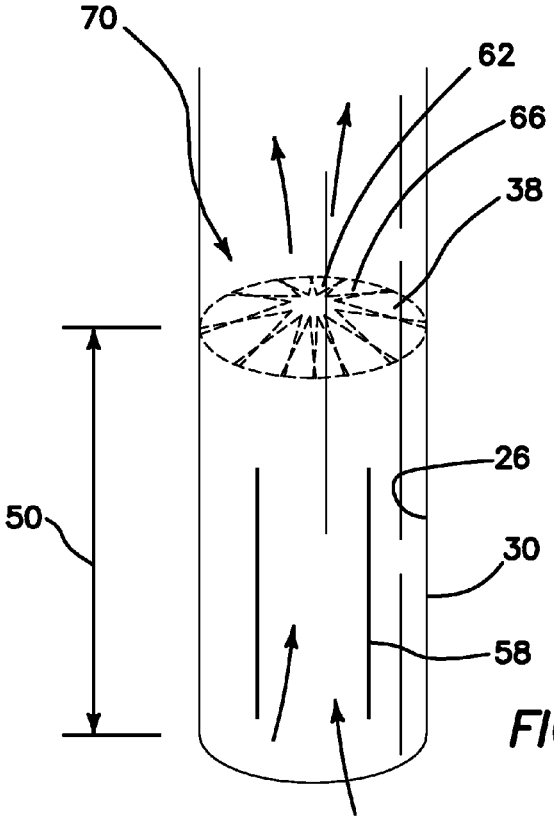
FIG. 3 is a partial perspective view of the lower end of the FIG. 1 embodiment illustrating vertical slits in the hollow body.

(2) In a variant of the invention, as illustrated in FIGS. 2 and 3, the inner 26 and outer 30 walls extend below the one-way valve 38 for a first predetermined distance 50.

Figure 6:
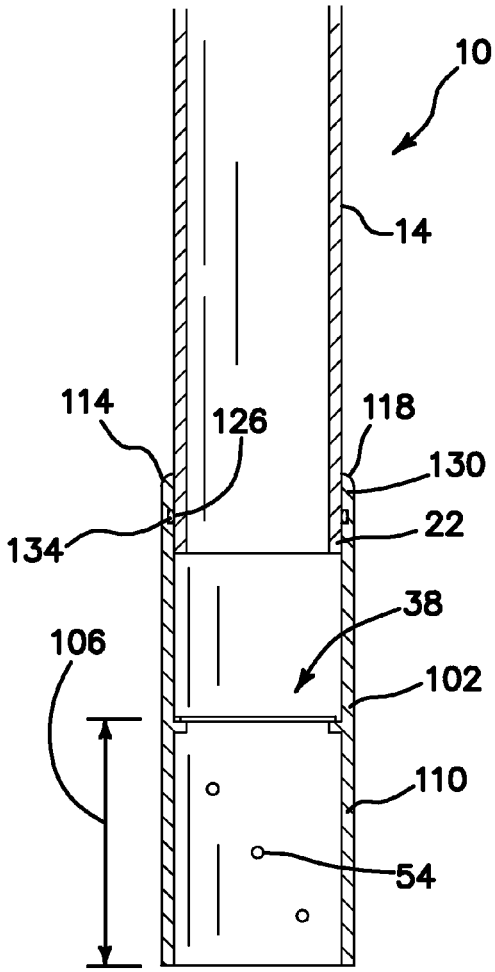
FIG. 6 is a cross-sectional view of the FIG. 1 embodiment illustrating a sleeve attached to a lower end of the hollow body containing a one-way valve and venting apertures.

(3) In another variant, as illustrated in FIGS. 3 and 6, the inner 26 and outer 30 walls extending below the one-way valve 38 have either at least one aperture 54 or at least one slit 58.

(4) In still another variant, the one-way valve 38 includes a plurality of overlapping inwardly folding pleats 62. The pleats 62 are formed of resilient material 66.

(5) In yet another variant, the inwardly folding pleats 62 are initially held in a sealing position 70 by a frangible adhesive 74.

Figure 4:
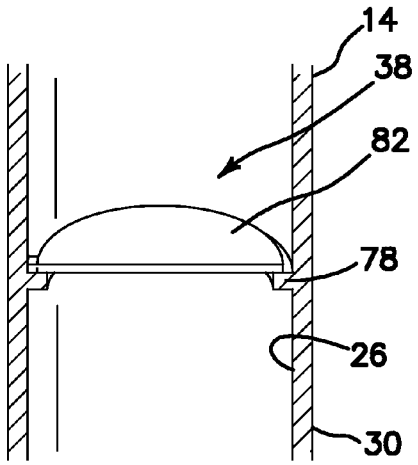
FIG. 4 is a cross-sectional view of the FIG. 1 embodiment illustrating a one-piece flapper-type valve within the hollow body in the closed position.
Figure 4A:
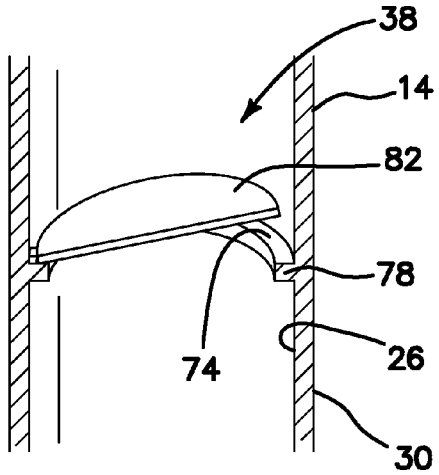
FIG. 4A is a cross-sectional view of the FIG. 1 embodiment illustrating a one-piece flapper-type valve within the hollow body in the open position.

(6) In a further variant, as illustrated in FIGS. 4 and 4A, the one-way valve 38 includes a surrounding ledge 78 and a flap 82. The ledge 78 is located upon the inner wall 26 of the hollow body 14. The flap 82 is pivotally secured above and adjacent to the surrounding ledge 78.

(7) In still a further variant, the flap 82 is initially held in a sealing position 86 by a frangible adhesive 74.

Figure 5:
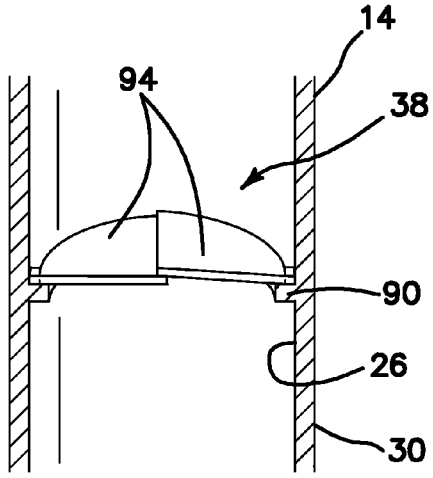
FIG. 5 is a cross-sectional view of the FIG. 1 embodiment illustrating a two-piece flapper-type valve within the hollow body in the closed position.
Figure 5A:
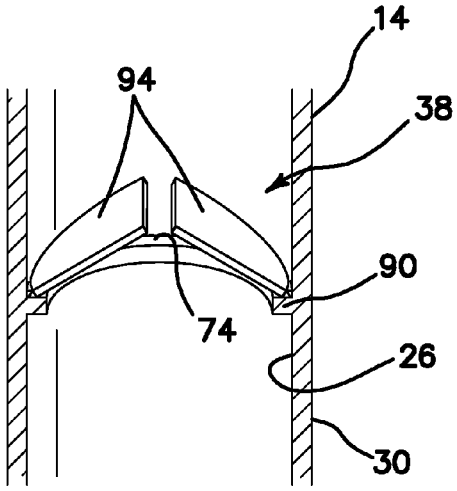
FIG. 5A is a cross-sectional view of the FIG. 1 embodiment illustrating a two-piece flapper-type valve within the hollow body in the open position.

(8) In yet a further variant, as illustrated in FIGS. 5 and 5A, the one-way valve 38 includes a surrounding ledge 90 and a pair of overlapping vanes 94. The ledge 90 is located upon the inner wall 26 of the hollow body 14 and the pair of vanes 94 is pivotally attached above and adjacent to the surrounding ledge 90.

(9) In yet another variant, the overlapping vanes 94 are initially held in a sealing position 98 by a frangible adhesive 74.

(10) In still another variant, as illustrated in FIG. 6, the one-way valve 38 is located within a sleeve 102. The sleeve 102 is sized and shaped to fit sealably over the second end 22 of the body 14.

(11) In yet another variant, the sleeve 102 extends below the one-way valve 38 for a first predetermined length 106.

(12) In a further variant, a portion of the sleeve 102 that extends below the one-way valve 38 has either at least one aperture 54 or at least one slit 58 penetrating a side wall 110 of the sleeve 102.

(13) In still a further variant, an upper end 114 of the sleeve 102 adjoins the outer wall 30 of the body 14 with either a rounded filet 118 or a beveled edge (not shown).

(14) In yet a further variant, a joint 126 between the second end 22 of the body 14 and a portion 130 of the sleeve 102 above the one-way valve 38 is secured with an O-ring seal 134.

(15) In another variant of the invention, as illustrated in FIG. 2, the frangible seal 34 has a burst strength greater than burst strength of the body 14.

Figure 7:
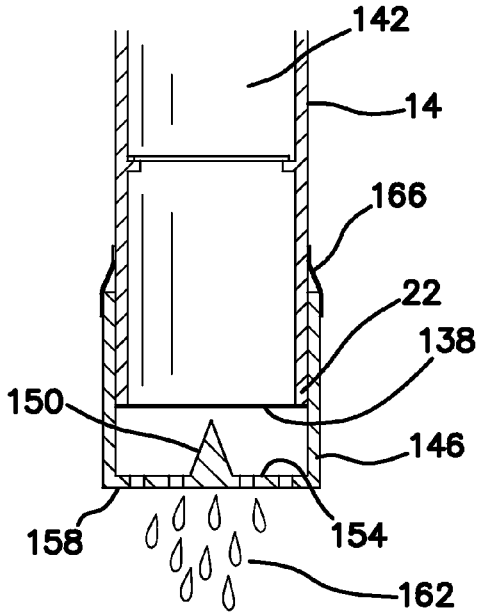
FIG. 7 is a cross-sectional view of the FIG. 1 embodiment illustrating a membrane sealing the lower end of hollow body and a sliding puncture device held in place with tape.
Figure 8:
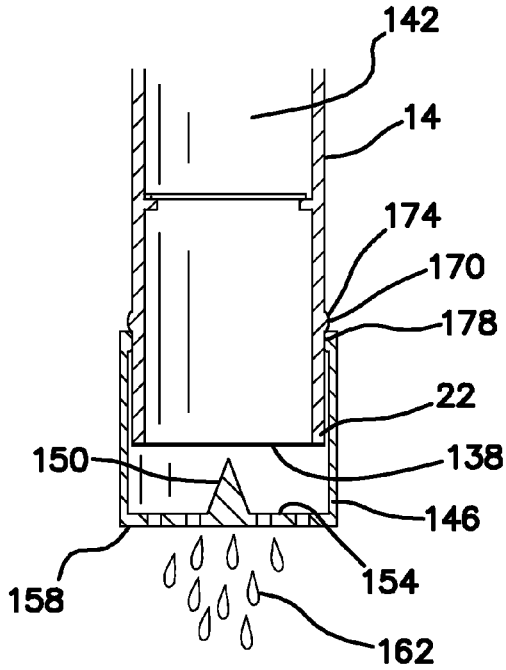
FIG. 8 is a cross-sectional view of the FIG. 1 embodiment illustrating a membrane sealing the lower end of hollow body and a sliding puncture device constrained from upward movement by a ridge surrounding the lower end of the body.

(16) In still another variant, as illustrated in FIGS. 7 and 8, a lower membrane 138 is provided. The membrane 138 seals the second end 22 of the body 14 and prevents contamination of an interior 142 of the body 14. A sliding puncture device 146 is provided. The device 146 is sized and shaped to fit slidably over the second end 22 of the body 14 and has an upward pointing puncturing member 150 affixed to an inner surface 154 of a perforated end cap 158. The puncturing member 150 penetrates the membrane 138 as the puncture device 146 is moved upwardly, thereby permitting the consumable liquid 46 to move upwardly under suction through the hollow body 14 and a mixing beverage 162 to pass into the body 14 through the perforated end cap 158.

(17) In yet another variant, a removable strip of sealing tape 166 is provided. The tape 166 secures the sliding puncture device 146 to the elongated body 14 to prevent accidental puncturing of the membrane 138.

(18) In a further variant, as illustrated in FIG. 8, a ridge 170 is located about a circumference 174 of the hollow body 14 and at least one resilient tab 178 is provided. The tab 178 is sized, shaped and located to impede upward movement of the sliding puncture device 146 and requires a predetermined force to permit passage of the device 146 beyond the ridge 170.

Figure 9:
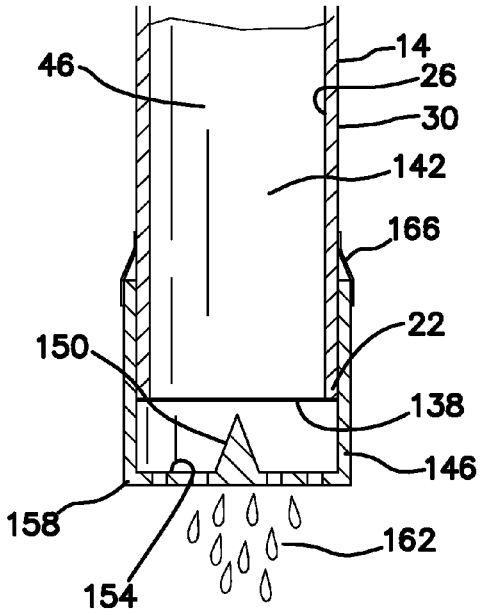
FIG. 9 is a cross-sectional view of another embodiment, without a one-way valve, illustrating a membrane sealing the lower end of hollow body and a sliding puncture device held in place with tape.
Figure 10:
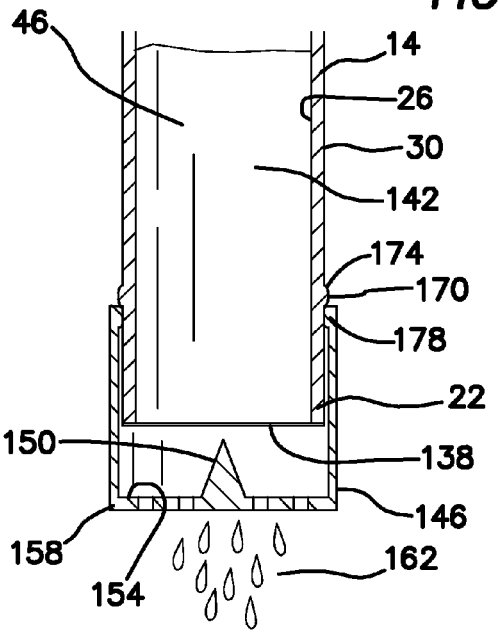
FIG. 10 is a cross-sectional view of the FIG. 9 embodiment, illustrating a membrane sealing the lower end of hollow body and a sliding puncture device constrained from upward movement by a ridge surrounding the lower end of the body.
Figure 11:
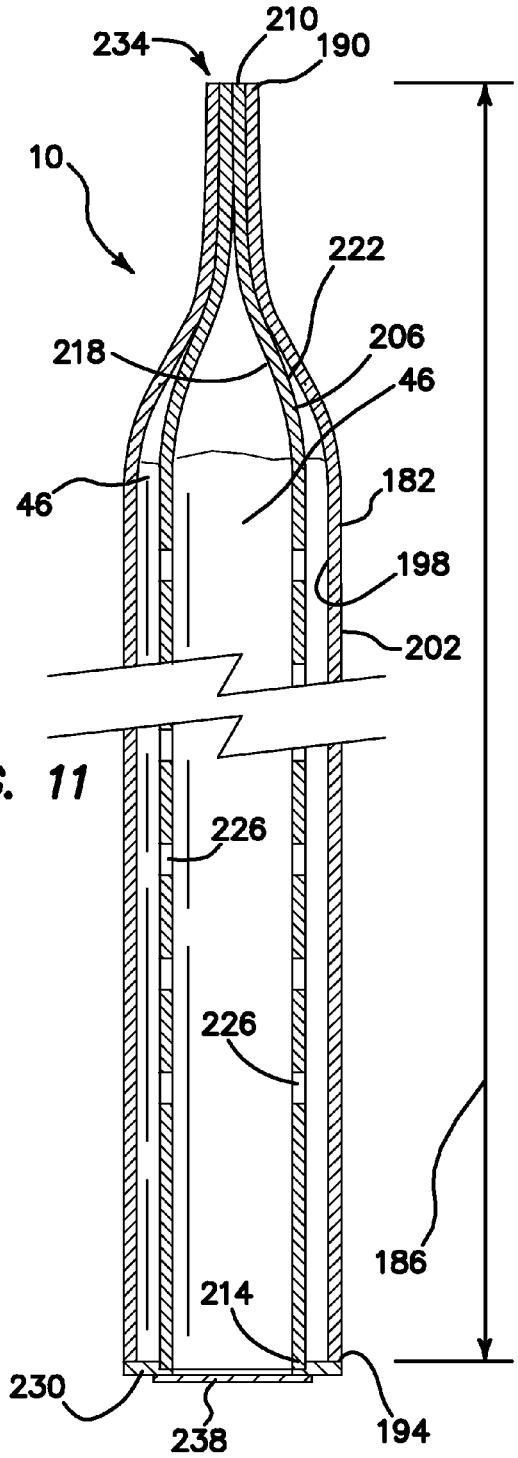
FIG. 11 is a cross-sectional view of another embodiment illustrating a straw within a straw in which the inner straw includes apertures connecting it to the interior of the outer straw.

(19) In still a further variant, as illustrated in FIGS. 9 and 10, a hollow, elongated body 14 is provided. The body 14 has a first end 18, a second end 22, an inner wall 26 and an outer wall 30. The body 14 has a frangible seal 34 at the first end 18 and a lower membrane 138. The membrane 138 seals the second end 22 of the body 14 and prevents contamination of an interior 142 of the body 14. The elongated body 14 securely encloses a predetermined quantity of a consumable liquid 46. A sliding puncture device 146 is provided. The device 146 is sized and shaped to fit slidably over the second end 22 of the body 14 and has an upward pointing puncturing member 150 affixed to an inner surface 154 of a perforated end cap 158. The puncturing member 150 penetrates the membrane 138 as the puncture device 146 is moved upwardly, thereby permitting the consumable liquid 46 to move upwardly under suction through the hollow body 14 and a mixing beverage 162 to pass into the body 14 through the perforated end cap 158.

(20) In yet a further variant, a removable strip of sealing tape 166 is provided. The tape 166 secures the sliding puncture device 146 to the elongated body 14 to prevent accidental puncturing of the membrane 138.

(21) In another variant of the invention, a ridge 170 is located about a circumference 174 of the hollow body 14 and at least one resilient tab 178 is provided. The tab 178 is sized, shaped and located to impede upward movement of the sliding puncture device 146 and requires a predetermined force to permit passage of the device 146 beyond the ridge 170.

(22) In still another variant, as illustrated in FIGS. 11-14, an outer elongated hollow body 182 is provided. The outer body 182 has a first predetermined length 186, a first end 190, a second end 194, an inner wall 198 and an outer wall 202. An inner elongated hollow body 206 is provided. The inner body 206 has the first predetermined length 186, a proximal end 210, a distal end 214, an inside wall 218, an outside wall 222 and a plurality of apertures 226 penetrating the inside 218 and outside 222 walls. A lower platform 230 is provided. The lower platform 230 connects and seals the outside wall 222 of the inner body 206 to the inner wall 198 of the outer body 182 and supports the inner body 206 within the outer body 182. A first frangible seal 234 is provided. The first seal 234 removably secures the first end 190 of the outer body 182 and the proximal end 210 of the inner body 206. A second frangible seal 238 is provided. The second seal 238 removably secures the distal end 214 of the inner body 206. A predetermined quantity of a consumable liquid 46 is provided. The liquid 46 is securely enclosed within the inner body 206 and between the inner body 206 and the outer body 182.

Figure 12:
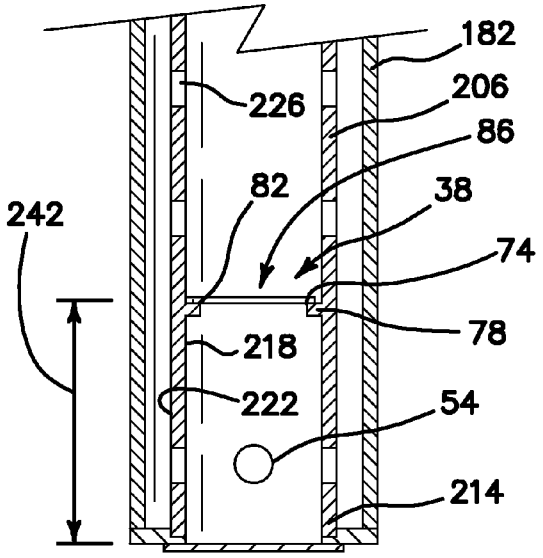
FIG. 12 is a cross-sectional view of the FIG. 11 embodiment, illustrating a one piece one-way valve in the inner straw and venting apertures.
Figure 13:
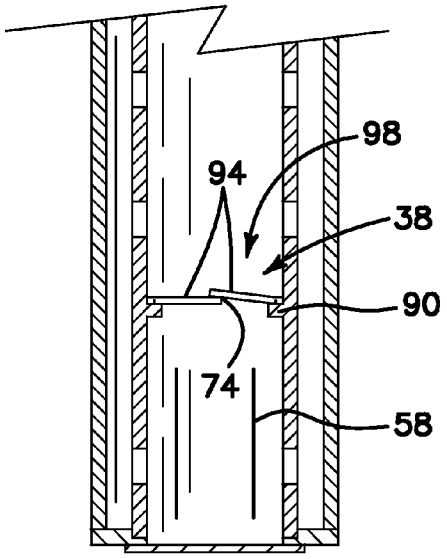
FIG. 13 is a cross-sectional view of the FIG. 11 embodiment, illustrating a two piece one-way valve in the inner straw and venting apertures.
Figure 14:
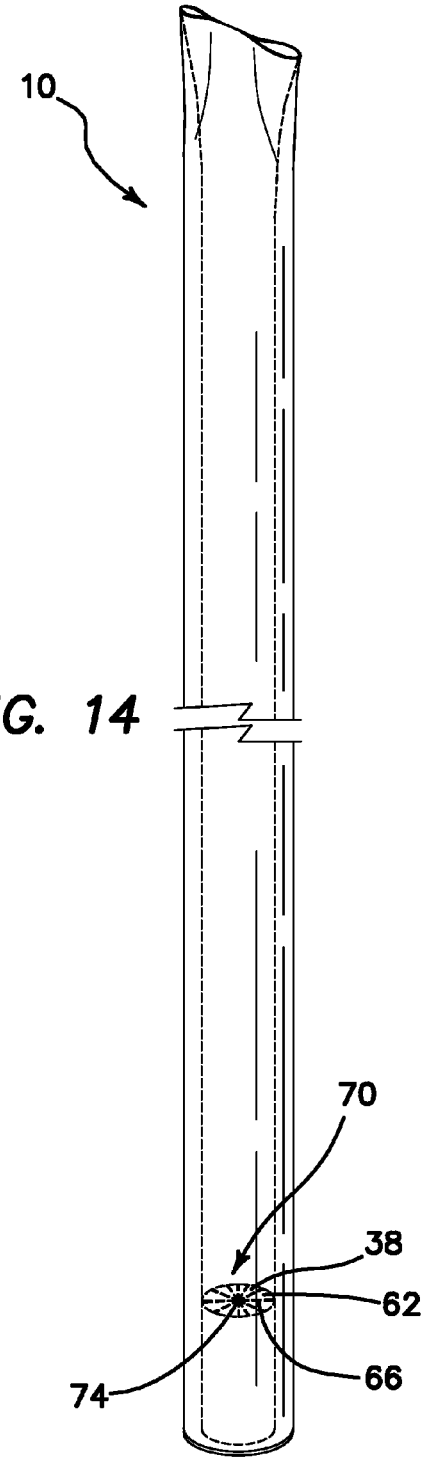
FIG. 14 is a perspective view of the FIG. 11 embodiment illustrating a one-way valve having circular folding pleats.

(23) In yet another variant, as illustrated in FIGS. 12-14, a one-way valve 38 is located adjacent the distal end 214 of the inner body 206. The one-way valve 38 permits passage of fluids only from the distal end 214 toward the proximal end 210.

(24) In a further variant, the inside 218 and outside 222 walls extend below the one-way valve 38 for a first predetermined distance 242.

(25) In still a further variant, the inside 218 and outside 222 walls that extend below the one-way valve 38 have either at least one aperture 54 or at least one slit 58.

(26) In yet a further variant, as illustrated in FIG. 14, the one-way valve 38 includes a plurality of overlapping inwardly folding pleats 62. The pleats 62 are formed of resilient material 66.

(27) In another variant of the invention, the inwardly folding pleats 66 are initially held in a sealing position 70 by a frangible adhesive 74.

(28) In still another variant, as illustrated in FIG. 12, the one-way valve 38 includes a surrounding ledge 78 and a flap 82. The ledge 78 is located upon the inner wall 218 of the inner hollow body 206. The flap 82 is pivotally secured above and adjacent to the surrounding ledge 78.

(29) In yet another variant, the flap 82 is initially held in a sealing position 86 by a frangible adhesive 74.

(30) In a further variant, as illustrated in FIG. 13, the one-way valve 38 includes a surrounding ledge 90 and a pair of overlapping vanes 94. The ledge 90 is located upon the inner wall 218 of the inner hollow body 206 and the pair of vanes 94 is pivotally attached above and adjacent to the surrounding ledge 90.

(31) In still a further variant, the overlapping vanes 94 are initially held in a sealing position 98 by a frangible adhesive 74.

Figure 15:
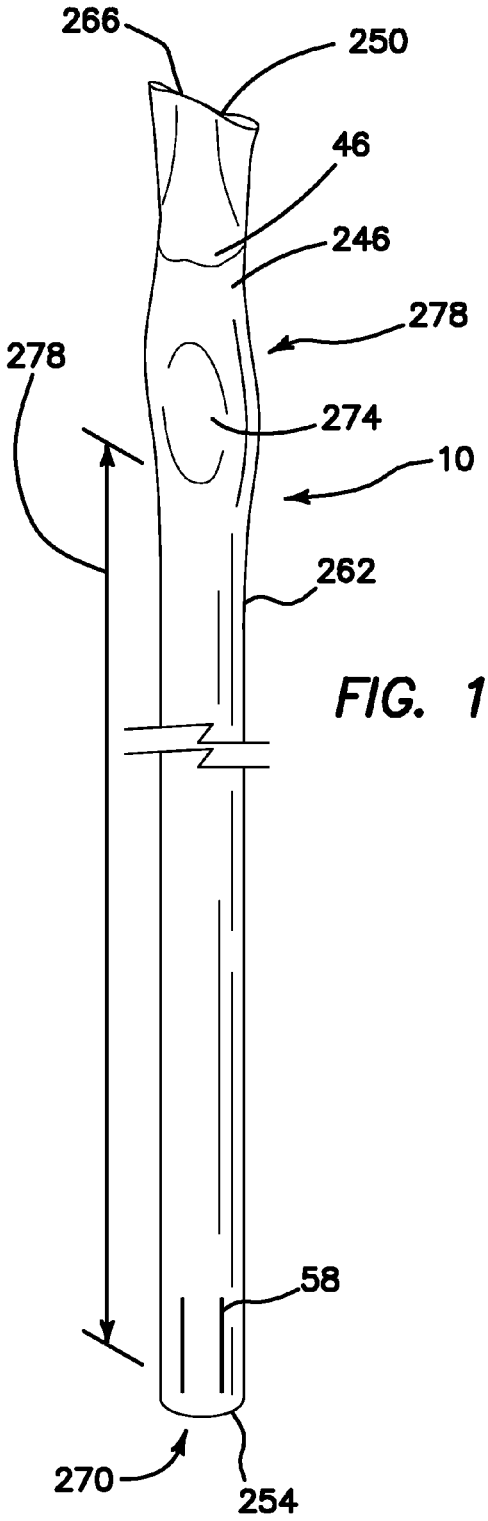
FIG. 15 is a perspective view of another embodiment illustrating a manually operated valve and frangible seal.
Figure 16:
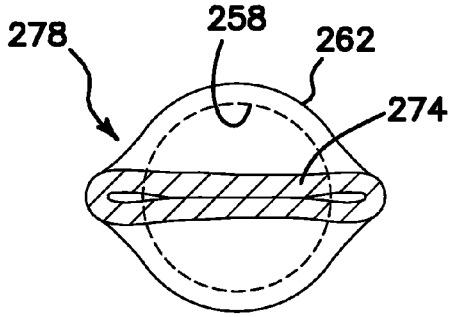
FIG. 16 is a cross-sectional view of the FIG. 15 embodiment, illustrating the manually operated valve in the closed position.
Figure 17:
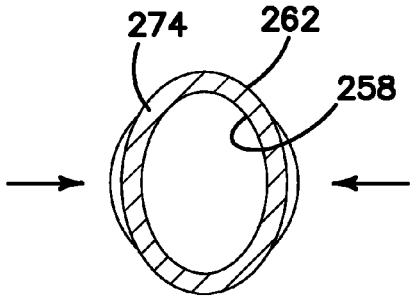
FIG. 17 is a cross-sectional view of the FIG. 15 embodiment, illustrating the manually operated valve in the open position.

(32) In yet a further variant, as illustrated in FIGS. 15-17, a hollow, elongated body 246 is provided. The body 246 has a first end 250, a second end 254, an inner wall 258 and an outer wall 262. The body 246 has a first frangible seal 266 at the first end 250 and a second frangible seal 270 at the second end 254. A manually operated valve 274 is located within the hollow body 246 and spaced downwardly from the first end 250. The elongated body 246 securely encloses a predetermined quantity of a consumable liquid 46.

(33) In still a further variant, the inner 258 and outer 262 walls extend below the valve 274 for a first predetermined distance 278.

(34) In yet a further variant, the inner 258 and outer 262 walls that extend below the valve 274 have either at least one aperture 54 or at least one slit 58.

(35) In another variant, the valve 274 is in a normally closed position 278 and opens upon manual pressure on the hollow body 246 adjacent the valve 274.

Figure 18:
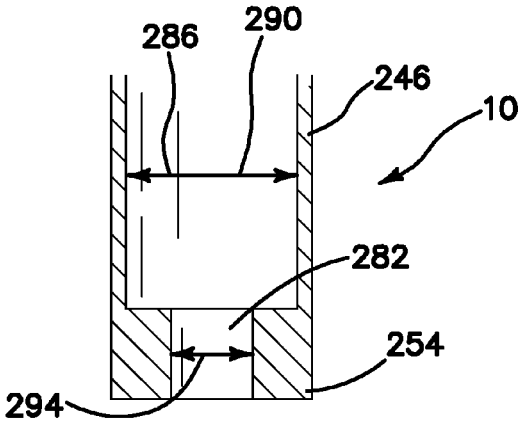
FIG. 18 is a cross-sectional view of another embodiment illustrating a choke at the lower end of the body.
Figure 19:
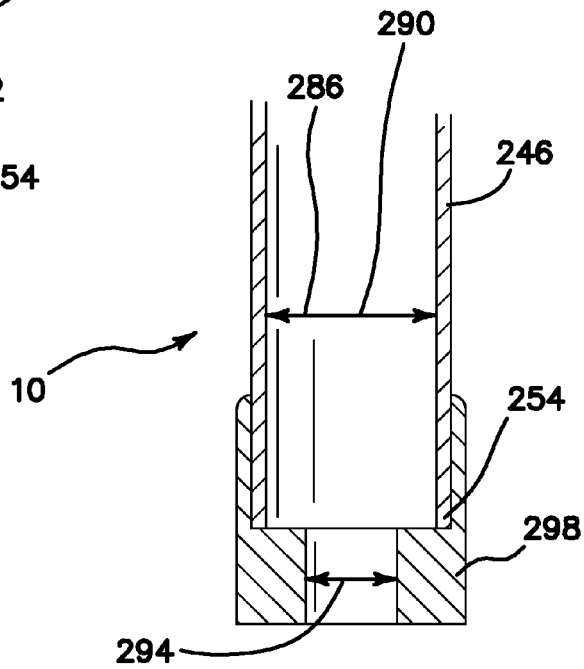
FIG. 19 is a cross-sectional view of the FIG. 18 embodiment illustrating the choke formed as part of a slip on cap.

(36) In still another variant, as illustrated in FIGS. 18-19, the second end 254 of the hollow, elongated body 246 further includes a choke 282. The choke 282 reduces a cross-sectional area 286 of the body 246 from a first predetermined size 290 to a second, smaller predetermined size 294.

(37) In yet another variant, the choke 282 further includes a sleeve 298. The sleeve 298 is sized and shaped to fit sealably over the second end 254 of the hollow, elongated body 246.

Figure 20:
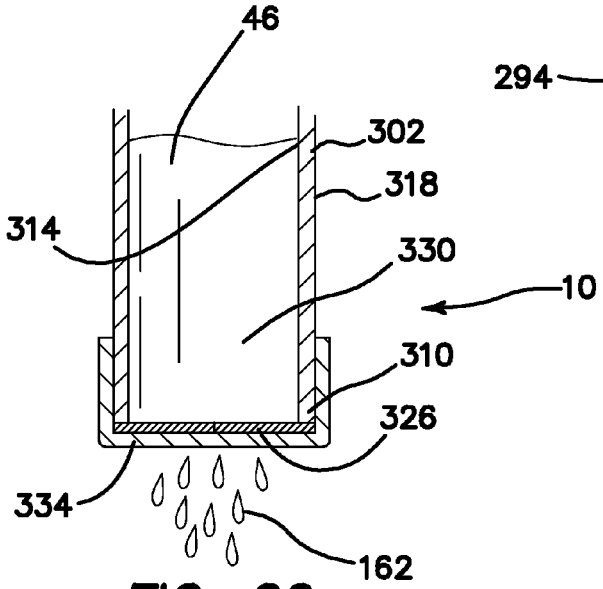
FIG. 20 is a cross-sectional view of another embodiment, illustrating a lower frangible membrane held in place by a protective cap.

(38) In a final variant of the invention, as illustrated in FIG. 20, a drink container straw 10 includes a hollow, elongated body 302. The body 302 has a first end (not shown), a second end 310, an inner wall 314 and an outer wall 318. The body 302 has a frangible seal 322 at the first end 10-08 and a lower membrane 326. The membrane 326 seals the second end 310 of the body 302 and prevents contamination of an interior 330 of the body 302. The elongated body 302 securely encloses a predetermined quantity of a consumable liquid 46. A protective end cap 334 is provided. The end cap 334 fits slidably over the outer wall 318 adjacent the second end 310 of the body 302. The end cap 334 secures the membrane 326 to the second end 310. The membrane 326 is breakable by suction applied to the straw 10 by a user. When the membrane 326 is broken it permits the consumable liquid 46 to move upwardly under suction through the hollow body 302 and permits a mixing beverage 162 to pass into the body 302 through the second end 310.

The drink straw container 10 has been described with reference to particular embodiments. Other modifications and enhancements can be made without departing from the spirit and scope of the claims that follow.

The invention claimed is:

1. A drinking container straw, comprising:

a hollow, elongated body, said body having a first end, a second end, an inner wall, and an outer wall;

said body having a frangible seal at said first end and a lower impermeable membrane, said membrane sealing said second end of said body and preventing contamination of an interior of said body;

said elongated body securely enclosing a predetermined quantity of consumable liquid;

a protective end cap, said end cap fitting slidably over said outer wall adjacent said second end of said body, said end cap securing said membrane to said second end; and said impermeable material of said membrane being broken to an non-repairable state by suction applied to said straw by a user, thereby permitting said consumable liquid to move upwardly under suction through said hollow body and a mixing beverage to pass into said body through said second end.

* * * * *